US008820808B1

(12) United States Patent
Chud

(10) Patent No.: US 8,820,808 B1
(45) Date of Patent: Sep. 2, 2014

(54) DUCT BELT

(71) Applicant: Richard I. Chud, Willow Grove, PA (US)

(72) Inventor: Richard I. Chud, Willow Grove, PA (US)

( * ) Notice: Subject to any disclaimer, the term of this patent is extended or adjusted under 35 U.S.C. 154(b) by 0 days.

(21) Appl. No.: 14/017,566

(22) Filed: Sep. 4, 2013

(51) Int. Cl.
*A45F 5/00* (2006.01)
*B65G 7/12* (2006.01)

(52) U.S. Cl.
USPC ..... 294/165; 294/141; 294/149

(58) Field of Classification Search
CPC .. A41F 1/002; A44D 2203/00; B25B 11/002; B25J 15/0608; B66C 1/04; H01F 7/0252; H01F 7/0257
USPC ..... 294/15, 27.1, 31.2, 65.5, 74, 119.2, 294/137, 141, 142, 149, 150, 153, 156, 294/165; 248/683, 206.5, 309.4; 16/406, 16/422, 425–427; 24/303
See application file for complete search history.

(56) References Cited

U.S. PATENT DOCUMENTS 656,049 A 8/1900 Saner
3,293,714 A * 12/1966 Shafer ..... 24/303
3,408,771 A * 11/1968 Garrett et al. ..... 49/34
D254,217 S 2/1980 Corrigan
4,221,628 A 9/1980 Rosenberg
4,696,505 A 9/1987 Shadoan
5,005,827 A * 4/1991 Steinbrecher ..... 482/16
5,236,087 A 8/1993 Morgan
5,800,106 A * 9/1998 Miller ..... 410/117
6,439,384 B2 8/2002 Martin
6,606,767 B2 8/2003 Wong
6,857,169 B2 * 2/2005 Chung ..... 24/303
7,070,142 B2 7/2006 Schnurr
7,926,860 B2 4/2011 Hill et al.
2011/0109108 A1 5/2011 Westmoreland
2013/0269629 A1 * 10/2013 Holt, Jr. ..... 119/863

* cited by examiner

*Primary Examiner* — Dean Kramer
(74) *Attorney, Agent, or Firm* — Kyle Fletcher, Esq.

(57) ABSTRACT

The duct belt is constructed of an adjustable belt member of no specific length that includes a first magnet member at a first distal end. The adjustable belt member includes a second magnet member at a second distal end. The first magnet member and the second magnet member each include lip protuberances that enable release of the magnet with respect to a ferrous object. The duct belt is configured to attach itself to a ferrous object, such as a roll of sheet metal or a metal plate in order to carry the ferrous object. The duct belt may further include an auxiliary handle member that utilizes magnets to provide an additional gripping member with respect to a metal plate.

13 Claims, 3 Drawing Sheets

DUCT BELT

CROSS REFERENCES TO RELATED APPLICATIONS

Not applicable

STATEMENT REGARDING FEDERALLY SPONSORED RESEARCH

Not applicable

REFERENCE TO APPENDIX

Not applicable

BACKGROUND OF THE INVENTION

Field of the Invention

The present invention relates to the field of ductwork, more specifically, an accessory that is able to transport a roll of ductwork.

SUMMARY OF THE INVENTION

An embodiment of the disclosure meets the needs presented above by generally comprising an adjustable belt member of no specific length that includes a first magnet member at a first distal end. The adjustable belt member includes a second magnet member at a second distal end. The first magnet member and the second magnet member each include lip protuberances that enable release of the magnet with respect to a ferrous object. The duct belt is configured to attach itself to a ferrous object, such as a roll of sheet metal or a metal plate in order to carry said handle member that utilizes magnets to provide an additional gripping member with respect to a metal plate.

An object of the invention is to provide a duct belt adapted for use with a ferrous object, which aids in manually transporting the ferrous object.

These together with additional objects, features and advantages of the duct belt will be readily apparent to those of ordinary skill in the art upon reading the following detailed description of presently preferred, but nonetheless illustrative, embodiments of the duct belt when taken in conjunction with the accompanying drawings.

In this respect, before explaining the current embodiments of the duct belt in detail, it is to be understood that the duct belt is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the duct belt.

It is therefore important that the claims be regarded as including such equivalent construction insofar as they do not depart from the spirit and scope of the duct belt. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
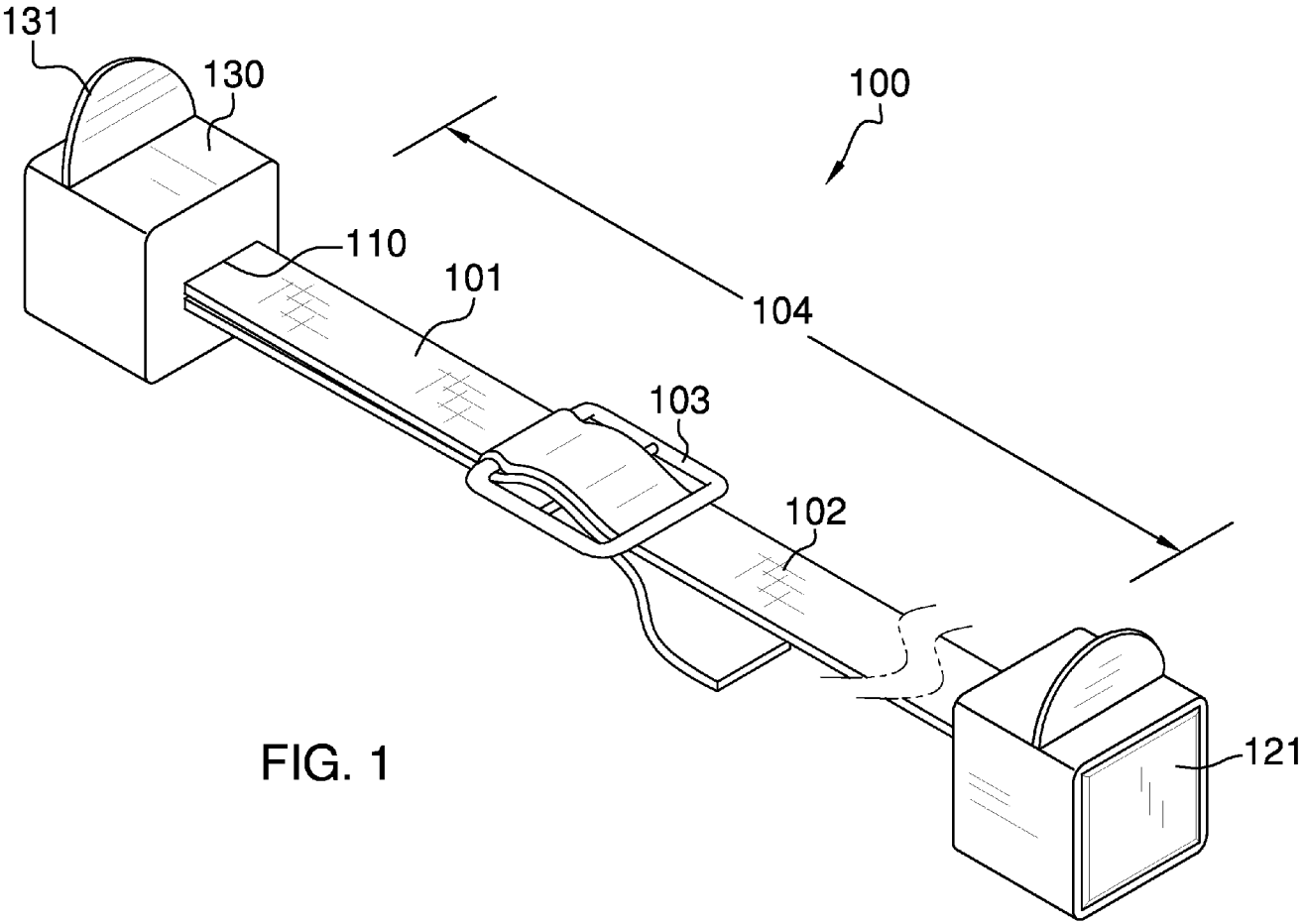
FIG. 1 is a perspective view of the duct belt by itself.
Figure 2:
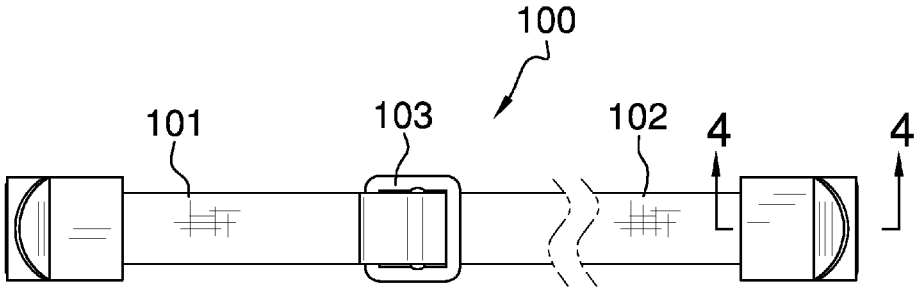
FIG. 2 is a front view of the duct belt by itself.
Figure 3:
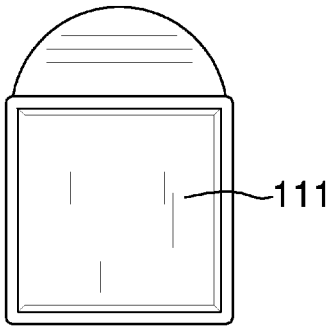
FIG. 3 is an end view of the duct belt.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

As best illustrated in FIGS. 1 through 6, the duct belt 100 is further comprised of a first belt member 101 and a second belt member 102. The first belt member 101 and the second belt member 102 adjust with respect to one another via a belt buckle member 103. The duct belt 100 forms a length 104 that is adjusted upon sliding the first belt member 101 with respect to the second belt member 102. The duct belt 100 is of no defined length 104, but is adjustable. The first belt member 101 and the second belt member 102 are made of a flexible strapping, which may be wrapped around a ferrous object 200.

The first belt member 101 is further defined with a first distal end 110 having a first magnet member 111 thereon. The second belt member 102 is also further defined with a second distal end 120 having a second magnet member 121. The first magnet member 111 is identical in construction with respect to the second magnet member 121.

The first magnet member 111 and the second magnet member 121 each include a magnet housing 130 that is of hollowed construction, and includes a lip protuberance 131 for detaching the first magnet member 111 or second magnet member 121 with respect to the ferrous object 200. It shall be noted that the duct belt 100 is configured for use with the ferrous object 200, which comprises a roll of sheet metal or a metal plate. The duct belt 100 attaches itself to the ferrous object 200 in order to aid in manually carrying the ferrous object 200. The first magnet member 111 and the second magnet member 121 are depicted with a square or cube-shaped body. However, it shall be noted that the first magnet member 111 and the second magnet member 121 may involve different shapes and sizes as needed.

Figure 4:
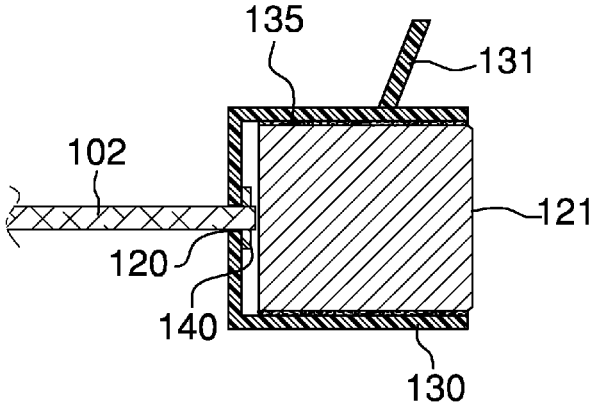
FIG. 4 is a cross-sectional view along line 4-4 in FIG. 2.
Figure 5:
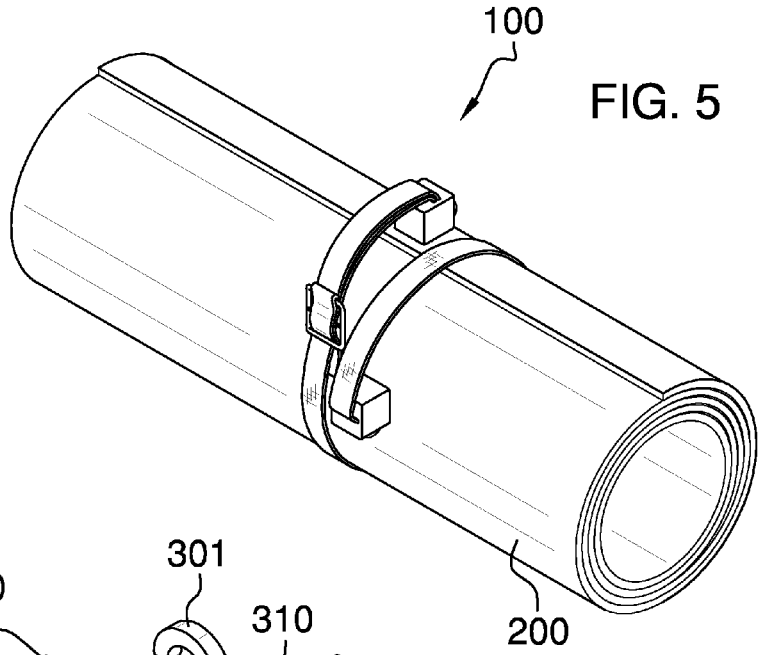
FIG. 5 is a perspective view of the duct belt in use with a roll of sheet metal.

In referring to FIG. 4, it shall be noted that the first magnet member 111 and the second magnet member 121 are secured to an interior of the magnet housing 130 via an adhesive 135, which may involve an epoxy. The first belt member 101 and the second belt member 102 utilize the first distal end 110 and the second distal end 120 to connect with the respective magnet housing 130. Moreover, a stop member 140 is provided at the first distal end 110 and the second distal end 120 in order to secure the magnet housing 130 to the first belt member 101 and the second belt member 102, respectively.

Figure 6:
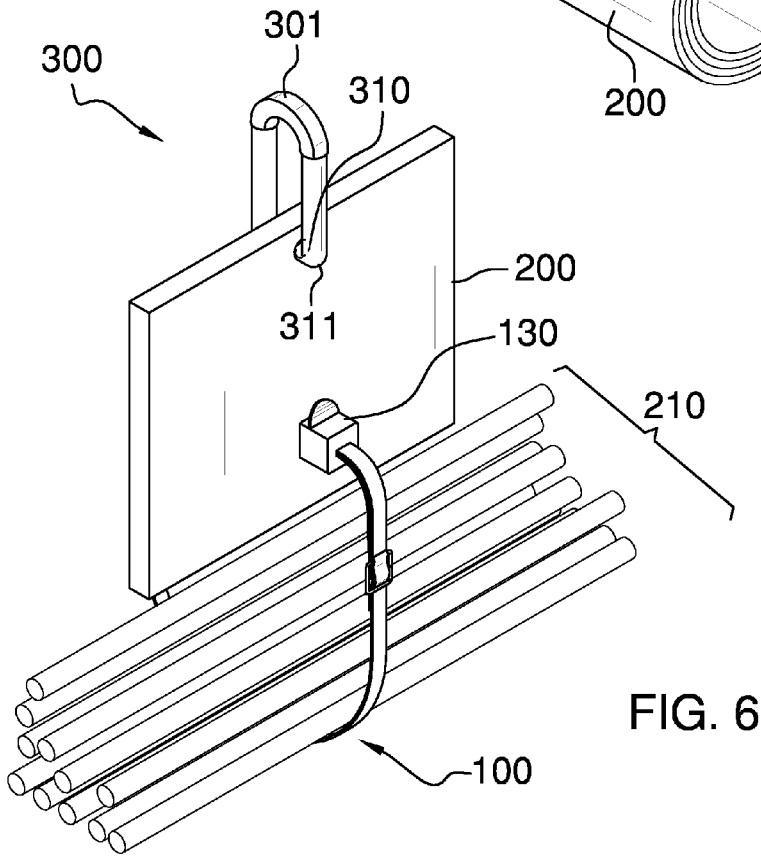
FIG. 6 is a perspective view of the duct belt in use with a metal plate and the auxiliary handle member.

Referring to FIG. 6, the duct belt 100 may be used in concert with an auxiliary handle member 300 that utilizes magnets to provide an additional gripping member with respect to the ferrous object 200. The auxiliary handle member 300 includes a soft grip 301 at a top distal end, which is grasped by hand in order to lift the auxiliary handle member 300, the duct belt 100, and the ferrous object 200 as well as any other object 210. The auxiliary handle member 300 includes a "U" shaped body that includes magnet members 310 to attach to the ferrous object 200. The magnet members 310 are located at bottom distal ends 311, and are oriented inwardly in order to attract the magnet members 310 to the ferrous object 200.

With respect to the above description, it is to be realized that the optimum dimensional relationship for the various components of the duct belt 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the duct belt 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A duct belt comprising:

a first belt member and a second belt member that connect and adjust a length via a belt buckle member;

a first magnet member is provided at a first distal end of the first belt member;

a second magnet member is provided at a second distal end of the second belt member;

wherein the first magnet member and the second magnet member are configured to attach to a ferrous object whilst the first belt member and the second belt member provide for manually transporting the ferrous object;

wherein the first magnet member and the second magnet member each include a magnet housing that is of hollowed construction, and includes a lip protuberance for detaching the first magnet member or second magnet member with respect to the ferrous object;

wherein the first magnet member and the second magnet member are secured to an interior of the respective magnet housing via an adhesive.

2. The duct belt according to claim 1 wherein the first belt member and the second belt member utilize the first distal end and the second distal end to connect with the respective magnet housing.

3. The duct belt according to claim 2 wherein a stop member is provided at the first distal end and the second distal end in order to secure the magnet housing to the first belt member and the second belt member, respectively.

4. The duct belt according to claim 1 wherein an auxiliary handle member is used in concert with the duct belt to aid in transport of the ferrous object.

5. The duct belt according to claim 4 wherein the auxiliary handle member includes a soft grip at a top distal end of a "U" shaped body in order to manually grasp the auxiliary handle member.

6. The duct belt according to claim 5 wherein magnets are provided at bottom distal ends of the "U" shaped body, and are oriented inwardly in order to attract to the ferrous object.

7. A duct belt comprising:

a first belt member and a second belt member that connect and adjust a length via a belt buckle member;

a first magnet member is provided at a first distal end of the first belt member;

a second magnet member is provided at a second distal end of the second belt member;

wherein the first magnet member and the second magnet member are configured to attach to a ferrous object whilst the first belt member and the second belt member provide for manually transporting the ferrous object;

wherein an auxiliary handle member is used in concert with the duct belt to aid in transport of the ferrous object.

8. The duct belt according to claim 7 wherein the first magnet member and the second magnet member each include a magnet housing that is of hollowed construction, and includes a lip protuberance for detaching the first magnet member or second magnet member with respect to the ferrous object.

9. The duct belt according to claim 8 wherein the first magnet member and the second magnet member are secured to an interior of the respective magnet housing via an adhesive.

10. The duct belt according to claim 9 wherein the first belt member and the second belt member utilize the first distal end and the second distal end to connect with the respective magnet housing.

11. The duct belt according to claim 10 wherein a stop member is provided at the first distal end and the second distal end in order to secure the magnet housing to the first belt member and the second belt member, respectively.

12. The duct belt according to claim 11 wherein the auxiliary handle member includes a soft grip at a top distal end of a "U" shaped body in order to manually grasp the auxiliary handle member.

13. The duct belt according to claim 12 wherein magnets are provided at bottom distal ends of the "U" shaped body, and are oriented inwardly in order to attract to the ferrous object.

* * * * *